US008973657B2

(12) United States Patent
Miller et al.

(10) Patent No.: US 8,973,657 B2
(45) **Date of Patent: *Mar. 10, 2015**

(54) GAS GENERATOR FOR PRESSURIZING DOWNHOLE SAMPLES

(71) Applicant: Halliburton Energy Services, Inc., Houston, TX (US)

(72) Inventors: Scott L. Miller, Highland Village, TX (US); Cyrus A. Irani, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/905,859

(22) Filed: May 30, 2013

(65) Prior Publication Data

US 2013/0264053 A1 Oct. 10, 2013

Related U.S. Application Data

(63) Continuation of application No. 12/962,621, filed on Dec. 7, 2010, now Pat. No. 8,474,533.

(51) Int. Cl.
*E21B 49/08* (2006.01)

(52) U.S. Cl.
CPC ..... *E21B 49/081* (2013.01)
USPC ..... 166/264; 166/63; 166/65.1; 166/309

(58) Field of Classification Search
CPC ..... E21B 49/081; E21B 49/082
USPC ..... 166/63, 65.1, 162, 264, 309
See application file for complete search history.

(56) References Cited

U.S. PATENT DOCUMENTS 2,076,308 A 4/1937 Wells
2,189,936 A 2/1940 Brandfon (Continued)

FOREIGN PATENT DOCUMENTS

WO 9925070 A2 5/1999
WO 0220942 A1 3/2002

(Continued)

OTHER PUBLICATIONS

Filing receipt and specification for provisional patent application entitled "Wellbore Servicing Tools, Systems and Methods Utilizing Near-Field Communication," by Zachary William Walton, et al., filed Mar. 12, 2013 as U.S. Appl. No. 61/778,312.

(Continued)

*Primary Examiner* — Giovanna Wright
*Assistant Examiner* — Richard Alker
(74) *Attorney, Agent, or Firm* — John W. Wustenberg; Baker Botts L.L.P.

(57) ABSTRACT

An apparatus for obtaining fluid samples in a subterranean wellbore comprises a carrier assembly configured to be disposed in a subterranean wellbore; a sampling chamber operably associated with the carrier assembly; a pressure assembly coupled to the sampling chamber and configured to pressurize a fluid sample obtained in the sampling chamber, wherein the pressure assembly is configured to contain a pressure generating agent; an activation mechanism configured to activate the pressure generating agent; and a power device operably associated with the carrier assembly and configured to provide an impulse for activating the activation mechanism, wherein the power device is not disposed on the pressure assembly.

20 Claims, 5 Drawing Sheets

(56) References Cited

U.S. PATENT DOCUMENTS 2,189,937 A 2/1940 Broyles
2,308,004 A 1/1943 Hart
2,330,265 A 9/1943 Burt
2,373,006 A 4/1945 Baker
2,381,929 A 8/1945 Schlumberger
2,618,340 A 11/1952 Lynd
2,618,343 A 11/1952 Conrad
2,637,402 A 5/1953 Baker et al.
2,640,547 A 6/1953 Baker et al.
2,695,064 A 11/1954 Ragan et al.
2,715,444 A 8/1955 Fewel
2,871,946 A 2/1959 Bigelow
2,918,125 A 12/1959 Sweetman
2,961,045 A 11/1960 Stogner et al.
2,974,727 A 3/1961 Goodwin
3,029,873 A 4/1962 Hanes
3,055,430 A 9/1962 Campbell
3,122,728 A 2/1964 Lindberg, Jr.
3,160,209 A 12/1964 Bonner
3,195,637 A 7/1965 Wayte
RE25,846 E 8/1965 Campbell
3,217,804 A 11/1965 Peter
3,233,674 A 2/1966 Leutwyler
3,266,575 A 8/1966 Owen
3,398,803 A 8/1968 Leutwyler et al.
3,556,211 A 1/1971 Bohn
3,659,648 A 5/1972 Cobbs
4,085,590 A 4/1978 Powell et al.
4,282,931 A 8/1981 Golben
4,352,397 A 10/1982 Christopher
4,377,209 A 3/1983 Golben
4,385,494 A 5/1983 Golben
4,402,187 A 9/1983 Golben et al.
4,598,769 A 7/1986 Robertson
4,796,699 A 1/1989 Upchurch
4,856,595 A 8/1989 Upchurch
4,884,953 A 12/1989 Golben
5,024,270 A 6/1991 Bostick
5,040,602 A 8/1991 Helms
5,058,674 A 10/1991 Schultz et al.
5,074,940 A 12/1991 Ochi et al.
5,089,069 A * 2/1992 Ramaswamy et al. ..... 149/21
5,101,907 A 4/1992 Schultz et al.
5,117,548 A 6/1992 Griffith et al.
5,155,471 A 10/1992 Ellis et al.
5,163,521 A 11/1992 Pustanyk et al.
5,188,183 A 2/1993 Hopmann et al.
5,197,758 A 3/1993 Lund et al.
5,211,224 A 5/1993 Bouldin
5,238,070 A 8/1993 Schultz et al.
5,279,321 A 1/1994 Krimm
5,316,081 A 5/1994 Baski et al.
5,316,087 A 5/1994 Manke et al.
5,355,960 A 10/1994 Schultz et al.
5,396,951 A 3/1995 Ross
5,452,763 A 9/1995 Owen
5,476,018 A 12/1995 Nakanishi et al.
5,485,884 A 1/1996 Hanley et al.
5,490,564 A 2/1996 Schultz et al.
5,531,845 A 7/1996 Flanigan et al.
5,558,153 A 9/1996 Holcombe et al.
5,573,307 A 11/1996 Wilkinson et al.
5,575,331 A 11/1996 Terrell
5,622,211 A 4/1997 Martin et al.
5,662,166 A 9/1997 Shammai
5,673,556 A 10/1997 Goldben et al.
5,687,791 A 11/1997 Beck et al.
5,700,974 A 12/1997 Taylor
5,725,699 A 3/1998 Hinshaw et al.
6,128,904 A 10/2000 Rosso, Jr. et al.
6,137,747 A 10/2000 Shah et al.
6,172,614 B1 1/2001 Robison et al.
6,186,226 B1 2/2001 Robertson
6,196,584 B1 3/2001 Shirk et al.
6,315,043 B1 11/2001 Farrant et al.
6,333,699 B1 12/2001 Zierolf
6,364,037 B1 4/2002 Brunnert et al.
6,378,611 B1 4/2002 Helderle
6,382,234 B1 5/2002 Birckhead et al.
6,438,070 B1 8/2002 Birchak et al.
6,450,258 B2 9/2002 Green et al.
6,450,263 B1 9/2002 Schwendemann
6,470,996 B1 10/2002 Kyle et al.
6,536,524 B1 3/2003 Snider
6,561,479 B1 5/2003 Eldridge
6,568,470 B2 5/2003 Goodson, Jr. et al.
6,583,729 B1 6/2003 Gardner et al.
6,584,911 B2 7/2003 Bergerson et al.
6,598,679 B2 7/2003 Robertson
6,619,388 B2 9/2003 Dietz et al.
6,651,747 B2 11/2003 Chen et al.
6,668,937 B1 12/2003 Murray
6,672,382 B2 1/2004 Schultz et al.
6,695,061 B2 2/2004 Fripp et al.
6,705,425 B2 3/2004 West
6,717,283 B2 4/2004 Skinner et al.
6,776,255 B2 8/2004 West et al.
6,848,503 B2 2/2005 Schultz et al.
6,880,634 B2 4/2005 Gardner et al.
6,915,848 B2 7/2005 Thomeer et al.
6,925,937 B2 8/2005 Robertson
6,971,449 B1 12/2005 Robertson
6,973,993 B2 12/2005 West et al.
6,998,999 B2 2/2006 Fripp et al.
7,012,545 B2 3/2006 Skinner et al.
7,063,146 B2 6/2006 Schultz et al.
7,063,148 B2 6/2006 Jabusch
7,068,183 B2 6/2006 Shah et al.
7,082,078 B2 7/2006 Fripp et al.
7,083,009 B2 8/2006 Paluch et al.
7,104,276 B2 9/2006 Einhaus
7,152,657 B2 12/2006 Bosma et al.
7,152,679 B2 12/2006 Simpson
7,165,608 B2 1/2007 Schultz et al.
7,191,672 B2 3/2007 Ringgenberg et al.
7,195,067 B2 3/2007 Manke et al.
7,197,923 B1 4/2007 Wright et al.
7,199,480 B2 4/2007 Fripp et al.
7,201,230 B2 4/2007 Schultz et al.
7,210,555 B2 5/2007 Shah et al
7,234,519 B2 6/2007 Fripp et al.
7,237,616 B2 7/2007 Patel
7,246,659 B2 7/2007 Fripp et al.
7,246,660 B2 7/2007 Fripp et al.
7,252,152 B2 8/2007 LoGiudice et al.
7,258,169 B2 8/2007 Fripp et al.
7,301,472 B2 11/2007 Kyle et al.
7,301,473 B2 11/2007 Shah et al.
7,322,416 B2 1/2008 Burris, II et al.
7,325,605 B2 2/2008 Fripp et al.
7,337,852 B2 3/2008 Manke et al.
7,339,494 B2 3/2008 Shah et al.
7,363,967 B2 4/2008 Burris, II et al.
7,367,394 B2 5/2008 Villareal et al.
7,372,263 B2 5/2008 Edwards
7,373,944 B2 5/2008 Smith et al.
7,387,165 B2 6/2008 Lopez de Cardenas et al.
7,395,882 B2 7/2008 Oldham et al.
7,398,996 B2 7/2008 Saito et al.
7,404,416 B2 7/2008 Schultz et al.
7,428,922 B2 9/2008 Fripp et al.
7,431,335 B2 10/2008 Khandhadia et al.
7,472,589 B2 1/2009 Irani et al.
7,472,752 B2 1/2009 Rogers et al.
7,508,734 B2 3/2009 Fink et al.
7,510,017 B2 3/2009 Howell et al.
7,557,492 B2 7/2009 Fripp et al.
7,559,363 B2 7/2009 Howell et al.
7,559,373 B2 7/2009 Jackson et al.
7,595,737 B2 9/2009 Fink et al.
7,596,995 B2 10/2009 Irani et al.
7,604,062 B2 10/2009 Murray
7,610,964 B2 11/2009 Cox
7,617,871 B2 11/2009 Surjaatmadja et al.

(56) References Cited

U.S. PATENT DOCUMENTS

| | | | |
|---|---|---|---|
| 7,624,792 | B2 | 12/2009 | Wright et al. |
| 7,640,965 | B2 | 1/2010 | Bosma et al. |
| 7,665,355 | B2 | 2/2010 | Zhang et al. |
| 7,669,661 | B2 | 3/2010 | Johnson |
| 7,673,506 | B2 | 3/2010 | Irani et al. |
| 7,673,673 | B2 | 3/2010 | Surjaatmadja et al. |
| 7,699,101 | B2 | 4/2010 | Fripp et al. |
| 7,699,102 | B2 | 4/2010 | Storm et al. |
| 7,712,527 | B2 | 5/2010 | Roddy |
| 7,717,167 | B2 | 5/2010 | Storm et al. |
| 7,730,954 | B2 | 6/2010 | Schultz et al. |
| 7,777,645 | B2 | 8/2010 | Shah et al. |
| 7,781,939 | B2 | 8/2010 | Fripp et al. |
| 7,802,627 | B2 | 9/2010 | Hofman et al. |
| 7,804,172 | B2 | 9/2010 | Schultz et al. |
| 7,832,474 | B2 | 11/2010 | Nguy |
| 7,836,952 | B2 | 11/2010 | Fripp |
| 7,856,872 | B2 | 12/2010 | Irani et al. |
| 7,878,255 | B2 | 2/2011 | Howell et al. |
| 7,946,166 | B2 | 5/2011 | Irani et al. |
| 7,946,340 | B2 | 5/2011 | Surjaatmadja et al. |
| 7,963,331 | B2 | 6/2011 | Surjaatmadja et al. |
| 7,987,914 | B2 | 8/2011 | Benton |
| 8,040,249 | B2 | 10/2011 | Shah et al. |
| 8,091,637 | B2 | 1/2012 | Fripp |
| 8,118,098 | B2 | 2/2012 | Hromas et al. |
| 8,140,010 | B2 | 3/2012 | Symons et al. |
| 8,146,673 | B2 | 4/2012 | Howell et al. |
| 8,162,050 | B2 | 4/2012 | Roddy et al. |
| 8,191,627 | B2 | 6/2012 | Hamid et al. |
| 8,196,515 | B2 | 6/2012 | Streibich et al. |
| 8,196,653 | B2 | 6/2012 | Fripp et al. |
| 8,215,404 | B2 | 7/2012 | Makowiecki et al. |
| 8,220,545 | B2 | 7/2012 | Storm, Jr. et al. |
| 8,225,014 | B2 | 7/2012 | Kuhl |
| 8,235,103 | B2 | 8/2012 | Wright et al. |
| 8,235,128 | B2 | 8/2012 | Dykstra et al. |
| 8,240,384 | B2 | 8/2012 | Miller et al. |
| 8,261,839 | B2 | 9/2012 | Fripp et al. |
| 8,276,669 | B2 | 10/2012 | Dykstra et al. |
| 8,276,675 | B2 | 10/2012 | Williamson et al. |
| 8,284,075 | B2 | 10/2012 | Fincher et al. |
| 8,297,367 | B2 | 10/2012 | Chen et al. |
| 8,302,681 | B2 | 11/2012 | Fripp et al. |
| 8,319,657 | B2 | 11/2012 | Godager |
| 8,322,426 | B2 | 12/2012 | Wright et al. |
| 8,327,885 | B2 | 12/2012 | Dykstra et al. |
| 8,356,668 | B2 | 1/2013 | Dykstra et al. |
| 8,376,047 | B2 | 2/2013 | Dykstra et al. |
| 8,387,662 | B2 | 3/2013 | Dykstra et al. |
| 8,397,803 | B2 | 3/2013 | Crabb et al. |
| 8,403,068 | B2 | 3/2013 | Robison et al. |
| 8,432,167 | B2 | 4/2013 | Reiderman |
| 8,459,377 | B2 | 6/2013 | Moyes |
| 8,472,282 | B2 | 6/2013 | Fink et al. |
| 8,474,533 | B2 | 7/2013 | Miller et al. |
| 8,479,831 | B2 | 7/2013 | Dykstra et al. |
| 8,505,639 | B2 | 8/2013 | Robison et al. |
| 2004/0156264 | A1 | 8/2004 | Gardner et al. |
| 2004/0227509 | A1 | 11/2004 | Ucan |
| 2005/0241835 | A1 | 11/2005 | Burris, II et al. |
| 2005/0260468 | A1 | 11/2005 | Fripp et al. |
| 2005/0269083 | A1 | 12/2005 | Burris, II et al. |
| 2006/0118303 | A1 | 6/2006 | Schultz et al. |
| 2006/0131030 | A1 | 6/2006 | Sheffield |
| 2006/0144590 | A1 | 7/2006 | Lopez de Cardenas et al. |
| 2006/0219438 | A1 | 10/2006 | Moore et al. |
| 2007/0189452 | A1 | 8/2007 | Johnson et al. |
| 2008/0135248 | A1 | 6/2008 | Talley et al. |
| 2008/0137481 | A1 | 6/2008 | Shah et al. |
| 2008/0202766 | A1 | 8/2008 | Howell et al. |
| 2009/0192731 | A1 | 7/2009 | De Jesus et al. |
| 2009/0308588 | A1 | 12/2009 | Howell et al. |
| 2010/0065125 | A1 | 3/2010 | Telfer |
| 2010/0084060 | A1 | 4/2010 | Hinshaw et al. |
| 2010/0201352 | A1 | 8/2010 | Englert |
| 2011/0042092 | A1 | 2/2011 | Fripp et al. |
| 2011/0079386 | A1 | 4/2011 | Fripp et al. |
| 2011/0139445 | A1 | 6/2011 | Fripp et al. |
| 2011/0168390 | A1 | 7/2011 | Fripp et al. |
| 2011/0174484 | A1 | 7/2011 | Wright et al. |
| 2011/0174504 | A1 | 7/2011 | Wright et al. |
| 2011/0199859 | A1 | 8/2011 | Fink et al. |
| 2011/0214853 | A1 | 9/2011 | Robichaux et al. |
| 2011/0253383 | A1 | 10/2011 | Porter et al. |
| 2011/0266001 | A1 | 11/2011 | Dykstra et al. |
| 2011/0308806 | A9 | 12/2011 | Dykstra et al. |
| 2012/0018167 | A1 | 1/2012 | Konopczynski et al. |
| 2012/0048531 | A1 | 3/2012 | Marzouk et al. |
| 2012/0075113 | A1 | 3/2012 | Loi et al. |
| 2012/0111577 | A1 | 5/2012 | Dykstra et al. |
| 2012/0146805 | A1 | 6/2012 | Vick, Jr. et al. |
| 2012/0152527 | A1 | 6/2012 | Dykstra et al. |
| 2012/0179428 | A1 | 7/2012 | Dykstra et al. |
| 2012/0186819 | A1 | 7/2012 | Dagenais et al. |
| 2012/0205120 | A1 | 8/2012 | Howell |
| 2012/0205121 | A1 | 8/2012 | Porter et al. |
| 2012/0211243 | A1 | 8/2012 | Dykstra et al. |
| 2012/0234557 | A1 | 9/2012 | Dykstra et al. |
| 2012/0241143 | A1 | 9/2012 | Wright et al. |
| 2012/0255739 | A1 | 10/2012 | Fripp et al. |
| 2012/0255740 | A1 | 10/2012 | Fripp et al. |
| 2012/0279593 | A1 | 11/2012 | Fripp et al. |
| 2012/0313790 | A1 | 12/2012 | Heijnen et al. |
| 2012/0318511 | A1 | 12/2012 | Dykstra et al. |
| 2012/0318526 | A1 | 12/2012 | Dykstra et al. |
| 2012/0323378 | A1 | 12/2012 | Dykstra et al. |
| 2013/0000922 | A1 | 1/2013 | Skinner et al. |
| 2013/0014940 | A1 | 1/2013 | Fripp et al. |
| 2013/0014941 | A1 | 1/2013 | Tips et al. |
| 2013/0014955 | A1 | 1/2013 | Fripp et al. |
| 2013/0014959 | A1 | 1/2013 | Tips et al. |
| 2013/0020090 | A1 | 1/2013 | Fripp et al. |
| 2013/0048290 | A1 | 2/2013 | Howell et al. |
| 2013/0048291 | A1 | 2/2013 | Merron et al. |
| 2013/0048298 | A1 | 2/2013 | Merron et al. |
| 2013/0048299 | A1 | 2/2013 | Fripp et al. |
| 2013/0048301 | A1 | 2/2013 | Gano et al. |
| 2013/0075107 | A1 | 3/2013 | Dykstra et al. |
| 2013/0092381 | A1 | 4/2013 | Dykstra et al. |
| 2013/0092382 | A1 | 4/2013 | Dykstra et al. |
| 2013/0092392 | A1 | 4/2013 | Dykstra et al. |
| 2013/0092393 | A1 | 4/2013 | Dykstra et al. |
| 2013/0098614 | A1 | 4/2013 | Dagenais et al. |
| 2013/0106366 | A1 | 5/2013 | Fripp et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0122296 | A1 | 5/2013 | Rose et al. |
| 2013/0140038 | A1 | 6/2013 | Fripp et al. |
| 2013/0153238 | A1 | 6/2013 | Fripp et al. |
| 2013/0180727 | A1 | 7/2013 | Dykstra et al. |
| 2013/0180732 | A1 | 7/2013 | Acosta et al. |
| 2013/0186634 | A1 | 7/2013 | Fripp et al. |
| 2013/0192829 | A1 | 8/2013 | Fadul et al. |

FOREIGN PATENT DOCUMENTS

| | | | |
|---|---|---|---|
| WO | 2004018833 | A1 | 3/2004 |
| WO | 2004099564 | A2 | 11/2004 |
| WO | 2010002270 | A2 | 1/2010 |
| WO | 2010111076 | A2 | 9/2010 |
| WO | 2011021053 | A2 | 2/2011 |
| WO | 2011087721 | A1 | 7/2011 |
| WO | 2012078204 | A1 | 6/2012 |
| WO | 2012082248 | A1 | 6/2012 |
| WO | 2013032687 | A2 | 3/2013 |
| WO | 2013032687 | A3 | 3/2013 |
| WO | 2014092836 | A1 | 6/2014 |

OTHER PUBLICATIONS

Filing receipt and specification for patent application entitled "Dual Magnetic Sensor Actuation Assembly," by Zachary W. Walton, et al.,

(56) References Cited

OTHER PUBLICATIONS filed Mar. 14, 2013 as U.S. Appl. No. 13/828,824.
Filing receipt and specification for patent application entitled "Method and Apparatus for Magnetic Pulse Signature Actuation," by Zachary W. Walton, et al., filed Feb. 28, 2013 as U.S. Appl. No. 13/781,093.
Filing receipt and specification for patent application entitled "Pressure Relief-Assisted Packer," by Lonnie Carl Helms, et al., filed Oct. 25, 2012 as U.S. Appl. No. 13/660,678.
Filing receipt and specification for patent application entitled "Wellbore Servicing Tools, Systems and Methods Utilizing Downhole Wireless Switches," by Michael Linley Fripp, et al., filed on May 31, 2013 as U.S. Appl. No. 13/907,593.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/913,881.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,004.
Filing receipt and specification for patent application entitled, "Wellbore Servicing Tools, Systems, and Methods Utilizing Near-Field Communication," by Zachary William Walton, et al., filed Jun. 10, 2013 as U.S. Appl. No. 13/914,114.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,177.
Filing receipt and specification for patent application entitled "Wellbore Servicing Tools, Systems, and Methods Utilizing Near-Field Communication," by Zachary William Walton, et al., filed Jun. 10, 2013 as US. Appl. No. 13/914,216.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,238.
Filing receipt and specification for International application entitled "Pressure Equalization for Dual Seat Ball Valve," filed Mar. 8, 2013 as International application No. PCT/US2013/027666.
Filing receipt and specification for International application entitled "Autofill and Circulation Assembly and Method of Using the Same," filed Mar. 5, 2013 as International application No. PCT/US2013/027674.
Paus, Annika, "Near Field Communication in Cell Phones," Jul. 24, 2007, pp. 1-22 plus 1 cover and 1 content pages.
Sanni, Modiu L., et al., "Reservoir Nanorobots," Saudi Aramco Journal of Technology, Spring 2008, pp. 44-52.
Ward, Matt, et al., "RFID: Frequency, standards, adoption and innovation," JISC Technology and Standards Watch, May 2006, pp. 1-36.
Danaher product information, Motion Brakes, http://www.danahermotion.com/website/usa/eng/products/clutches_and_brakes/115836.php, Mar. 4, 2009, 3 pages, Danaher Motion.
Filing receipt and specification for patent application entitled "Remotely Activated Down Hole Systems and Methods," by Frank V. Acosta, et al., filed Mar. 7, 2012 as U.S. Appl. No. 13/414,016.
Filing receipt and specification for patent application entitled "External Casing Packer and Method of Performing Cementing Job," by Lonnie Helms, et al., filed Mar. 7, 2012 as U.S. Appl. No. 13/414,140.
Filing receipt and specification for patent application entitled "Method of Completing a Multi-Zone Fracture Stimulation Treatment of a Wellbore," by Steven G. Streich, et al., filed Sep. 21, 2012 as U.S. Appl. No. 13/624,173.
Foreign communication from a related counterpart application—International Search Report and Written Opinion, PCT/US2010/061047, Jun. 23, 2011, 7 pages.
Foreign communication from a related counterpart application—International Search Report and Written Opinion, PCT/US2011/036686, Nov. 30, 2011, 8 pages.
Foreign communication from a related counterpart application—International Preliminary Report on Patentability, PCT/US2011/036686, Jun. 12, 2013, 5 pages.
Foreign communication from a related counterpart application—International Search Report and Written Opinion, PCT/US2012/050762, Mar. 11, 2013, 12 pages.
Halliburton brochure entitled "Armada™ Sampling System," Sep. 2007, 2 pages.
Halliburton drawing 672.03800, May 4, 1994, p. 1 of 2.
Halliburton drawing 672.03800, May 4, 1994, p. 2 of 2.
Halliburton drawing 626.02100, Apr. 20, 1999, 2 pages.
Magneta Electromagnetic Clutches and Brakes catalog, Jan. 2004, 28 pages, Magneta GmbH & Co KG.
Office Action dated Dec. 22, 2011 (30 pages), U.S. Appl. No. 12/965,859 filed on Dec. 11, 2010.
Office Action dated Dec. 23, 2011 (34 pages), U.S. Appl. No. 12/688,058 filed on Jan. 15, 2010.
Office Action dated Dec. 24, 2012 (26 pages), U.S. Appl. No. 12/688,058 filed on Jan. 15, 2010.
Ogura product information, "Electromagnetic Clutch/Brake," http://www.ogura-clutch.com/products.html?category=2&by=type&no=1, Mar. 4, 2009, 4 pages, Ogura Industrial Corp.
Foreign communication from a related counterpart application—International Preliminary Report on Patentability, PCT/US2010/061047, Jul. 17, 2012, 5 pages.
Office Action dated Sep. 19, 2013 (17 pages), U.S. Appl. No. 12/688,058 filed on Jan. 15, 2010.
Office Action dated Sep. 19, 2013 (30 pages), U.S. Appl. No. 12/965,859 filed on Dec. 11, 2010.
Foreign communication from a related counterpart application—International Search Report and Written Opinion, PCT/US2013/061386, Apr. 10, 2014, 12 pages.
Advisory Action dated Jul. 1, 2014 (3 pages), U.S. Appl. No. 12/688,058 filed on Jan. 15, 2010.
Foreign communication from a related counterpart application—Australian Office Action, AU Application No. 2010341610, Feb. 27, 2014, 5 pages.
Notice of Allowance dated Jul. 15, 2014 (28 pages), U.S. Appl. No. 12/688,058 filed on Jan. 15, 2010.
Office Action (Final) dated Mar. 10, 2014 (13 pages), U.S. Appl. No. 12/688,058 filed on Jan. 15, 2010.
Office Action (Final) dated May 9, 2014 (16 pages), U.S. Appl. No. 12/965,859 filed on Dec. 11, 2010.

* cited by examiner

GAS GENERATOR FOR PRESSURIZING DOWNHOLE SAMPLES

CROSS-REFERENCE TO RELATED APPLICATIONS

This application is a continuation of U.S. patent application Ser. No. 12/962,621 filed Dec. 7, 2010, published as U.S. Patent Application Publication No. US 2012-0138292 A1, and entitled "Gas Generator for Pressurizing Downhole Samples," which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the subterranean well drilling and completion art, tests are performed on formations intersected by a wellbore. Such tests can be performed in order to determine geological or other physical properties of the formation and fluids contained therein. For example, parameters such as permeability, porosity, fluid resistivity, temperature, pressure, and bubble point may be determined. These and other characteristics of the formation and fluid contained therein may be determined by performing tests on the formation before the well is completed and placed in service.

One type of testing procedure measures the composition of the formation fluids by obtaining a fluid sample from the formation. In order to obtain a representative sample, the sample is preserved as it exists within the formation. A general sampling procedure involves lowering a sample chamber into the wellbore, obtaining a sample, and retrieving the sample in the sampling chamber to the surface for analysis. It has been found, however, that as the fluid sample is retrieved to the surface, the temperature and pressure of the fluid sample can decrease. This change in properties can cause the fluid sample to approach or reach saturation pressure creating the possibility of phase separation, which can result in asphaltene deposition and/or flashing of entrained gasses present in the fluid sample. Once such a process occurs, the resulting phase separation may be irreversible so that a representative sample cannot be obtained without re-running the procedure to take an additional sample.

SUMMARY

In an embodiment, an apparatus for obtaining fluid samples in a subterranean wellbore comprises a carrier assembly configured to be disposed in a subterranean wellbore; a sampling chamber operably associated with the carrier assembly; a pressure assembly coupled to the sampling chamber and configured to pressurize a fluid sample obtained in the sampling chamber, wherein the pressure assembly is configured to contain a pressure generating agent; an activation mechanism configured to activate the pressure generating agent; and a power device operably associated with the carrier assembly and configured to provide an impulse for activating the activation mechanism, wherein the power device is not disposed on the pressure assembly.

In an embodiment, a method comprises positioning a fluid sampler comprising a sampling chamber, a pressure assembly, and an activation mechanism in a subterranean wellbore, wherein the pressure assembly comprises a pressure generating agent that comprises an organic solid composition, a urea, a multi-component system, or any combination thereof; obtaining a fluid sample in the sampling chamber; activating, within the subterranean wellbore, the pressure generating agent with the activation mechanism to generate a pressurized fluid that is coupled to the sampling chamber; and pressurizing the fluid sample using the pressurized fluid.

In an embodiment, a method of generating pressure within a subterranean wellbore comprises positioning an activation mechanism and a pressure assembly comprising a pressure generating agent within a subterranean wellbore; activating, within the subterranean wellbore, the pressure generating agent with the activation mechanism to generate a pressurized fluid; and using the pressurized fluid to operate at least one tool disposed in the subterranean wellbore and coupled to the pressurized fluid.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
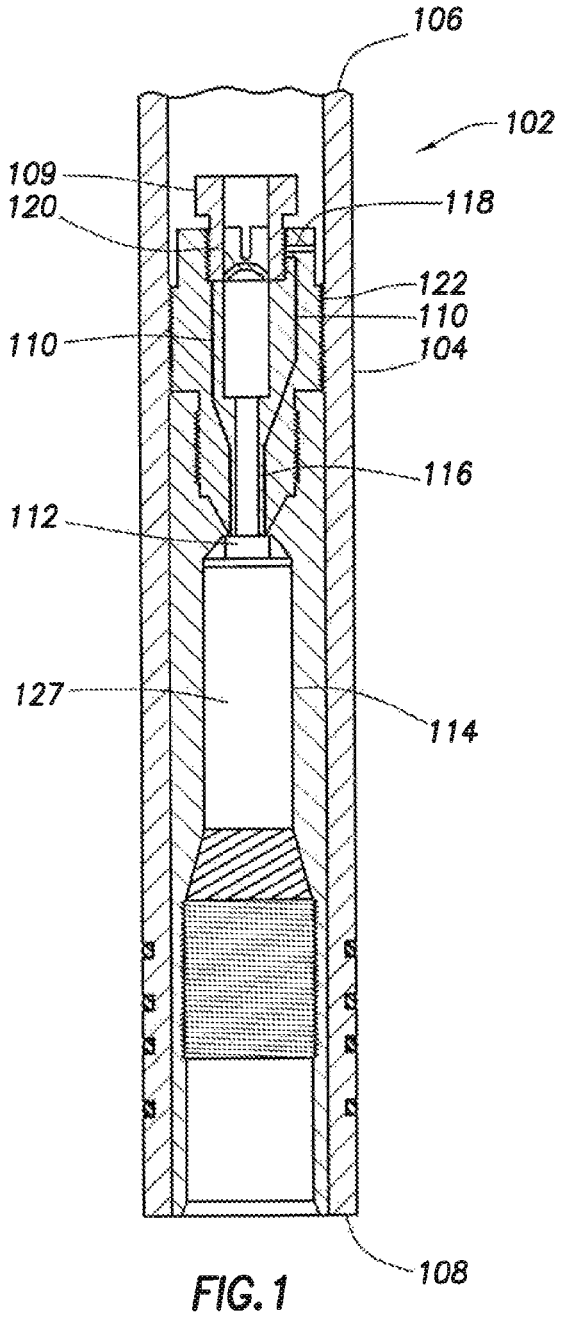
FIG. 1 is a cross-sectional view of an axial portion of an embodiment of a pressure assembly in accordance with the present disclosure.
Figure 2A:
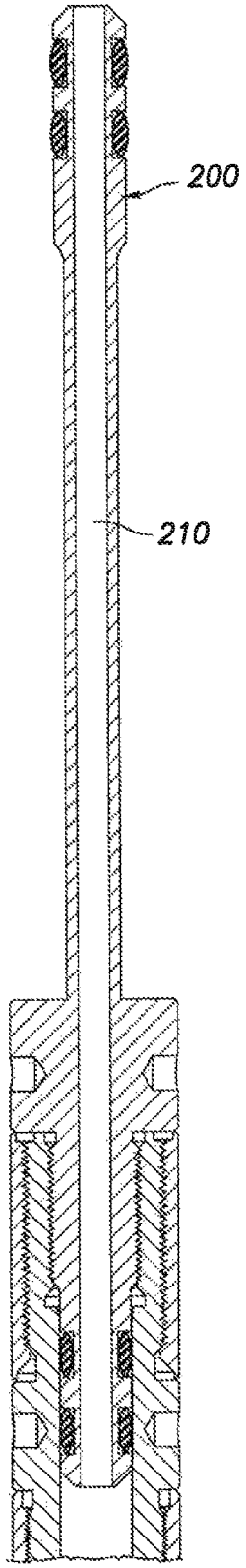
FIG. 2A-2F are cross sectional views of successive axial portions of an embodiment of a sampling section of a fluid sampler in accordance with the present disclosure.
Figure 2B:
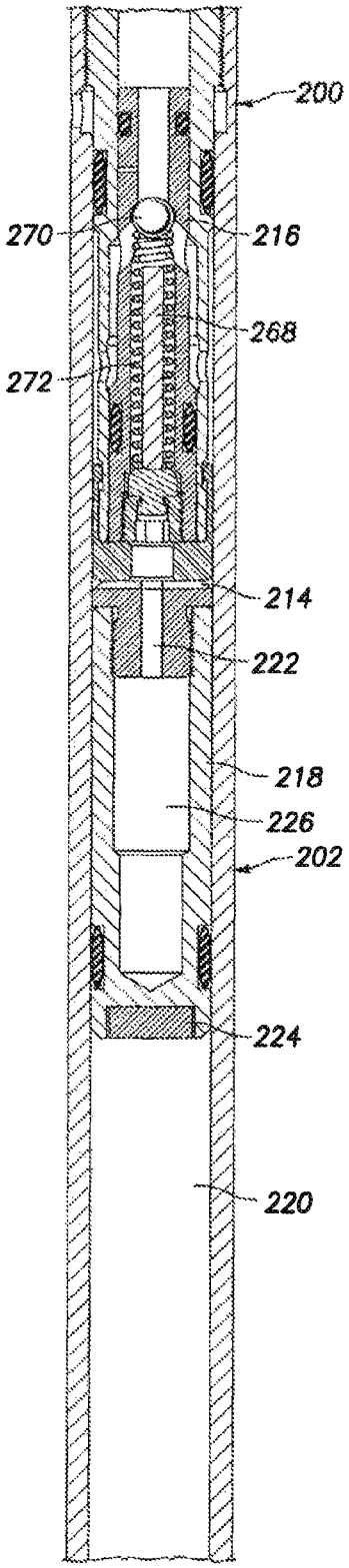
Figure 2C:
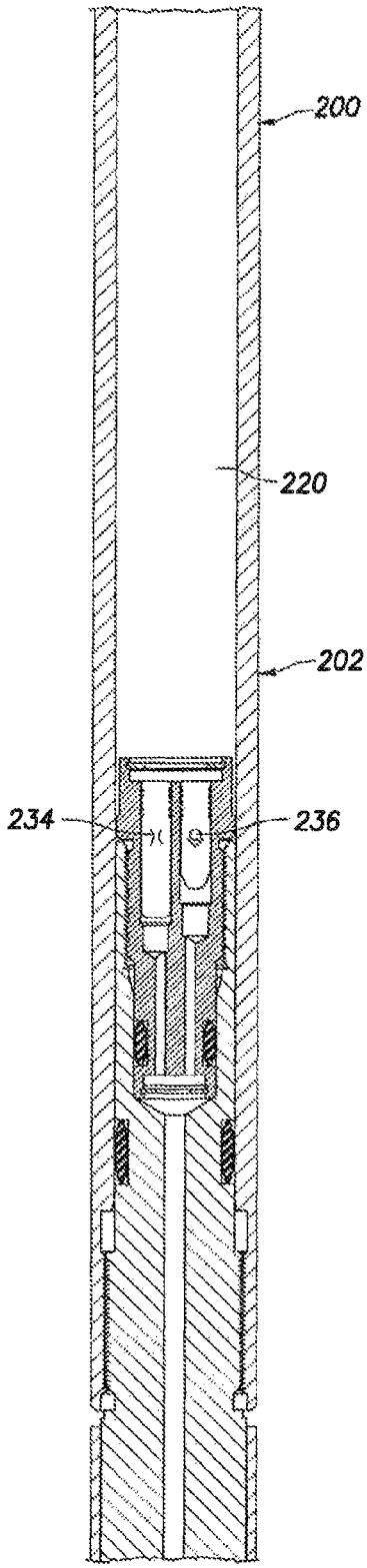
Figure 2D:
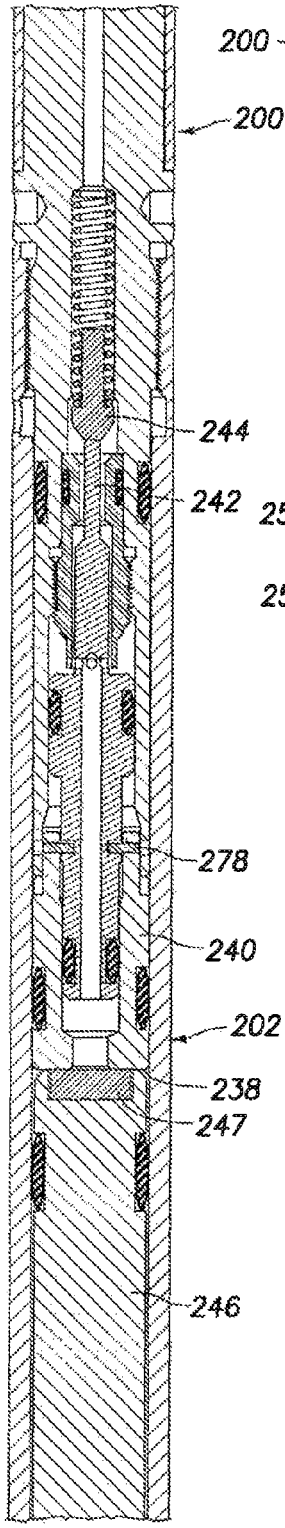
Figure 2E:
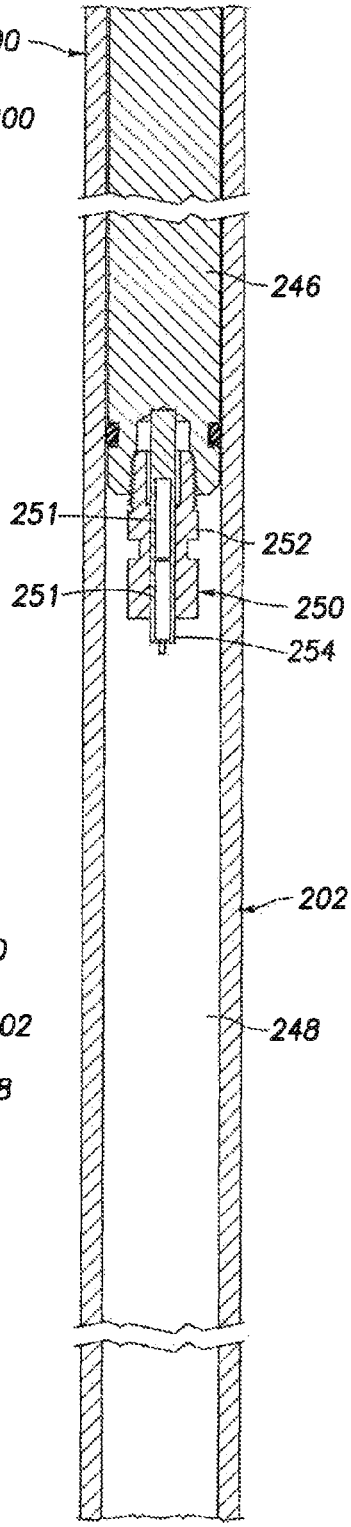
Figure 2F:
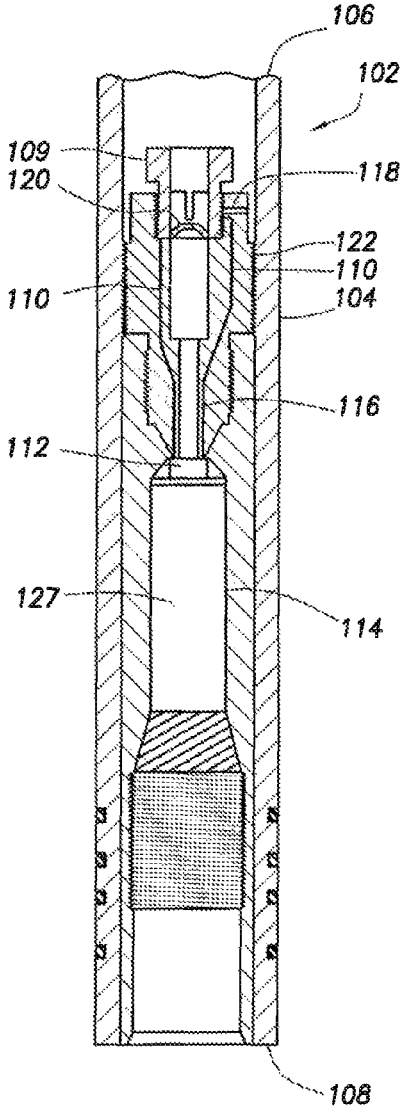

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The present disclosure provides a fluid sampling apparatus and a method for obtaining fluid samples from a formation without the need for a highly pressurized gas being charged to the apparatus on the surface of a wellbore. In a typical sampling procedure, a sample of the formation fluids may be obtained by lowering a sampling tool having a sampling chamber and a pressurized gas reservoir into the wellbore on a conveyance such as a wireline, slick line, coiled tubing, jointed tubing or the like. When the sampling tool reaches the desired depth, one or more ports are opened to allow collection of the formation fluids. Once the ports are opened, formation fluids travel through the ports and a sample of the formation fluids is collected within the sampling chamber of the sampling tool. It is understood that in practice, when taking a sample in a downhole environment, other fluids in addition to the formation fluids may be captured, for example some admixture of wellbore fluid, drilling mud, cement, acidation fluid, fracturing fluid, or other fluid that may be present in the wellbore. The pressurized gas reservoir may then be opened to allow the pressurized gas to pressurize the sample. After the sample has been collected and pressurized, the sampling tool may be withdrawn from the wellbore so that the formation fluid sample may be analyzed. The pressurized gas reservoir is filled at the surface of the wellbore with a gas such as nitrogen, and the gas reservoir pressures can be as high as 15,000 pounds per square inch ("psi"). The resulting pressurized fluid container may then present a safety risk to the personnel working around the wellbore prior to the tool being placed into the subterranean formation.

As disclosed herein, an alternative means of providing a pressurized gas reservoir includes the use of a pressure generating agent in an apparatus to provide a source of pressure. In some embodiments, the pressure generating agent can be a solid component, a liquid component, or any combination of components. An activation mechanism may be used to trigger the generation of pressure from the pressure generating agent through, for example, a chemical reaction. The resulting pressure may then be used to operate one or more tools in a wellbore, including providing a source of pressurized gas or fluid for pressurizing a sample of reservoir fluid.

The use of a pressure generating agent to create a source of pressure down hole can allow for the elimination of a high pressure gas within a wellbore tool at the surface of the well, prior to use of the tool. The use of the pressure generating agent can also allow for the pressure charging source (e.g., a high-pressure nitrogen source) to be eliminated at the well site, which may help to limit the high pressure sources located at the surface of the well. The elimination of a potentially dangerous pressure source may help prevent accidents at the well site. For example, the pressure generating agent may be maintained at near atmospheric pressure within a downhole tool until after the tool is disposed within the subterranean formation. Thus, the danger associated with the use of a high pressure fluid may be avoided until the tool is safely within the wellbore. Further, the charging vessel or storage vessel from which the downhole tool might otherwise be charged may be obviated, thereby removing another potential hazard from the well site. In some contexts herein the term fluid may refer to both liquids and gases, where the term is used to point out the ease of flow of the subject material and/or composition.

Turning now to FIG. 1, an embodiment of an activation mechanism and a pressure assembly comprising a pressure generating agent is illustrated. The pressure assembly 102 comprises an outer housing or carrier 104 that may comprise a cylindrical metallic body. The body may be constructed of any appropriate materials suitable for use in wellbore environments and configured to contain the pressure generated within the pressure assembly 102. In an embodiment, the pressure assembly 102 may be capable of containing up to about 15,000 psi, alternatively about 13,000 psi, or still alternatively about 10,000 psi. In an embodiment, the housing may be constructed of carbon steel or stainless steel. In an embodiment, the pressure assembly 102 includes a first end 106 and a second end 108. The first end 106 and second end 108 may be configured to be coupled with additional wellbore components. For example, the first end 106, the second end 108, or both may be threaded and act as a box connector and/or a pin connector in a wellbore tool string. Suitable connections may be provided to allow the pressure assembly 102 to be sealingly engaged to additional wellbore components, as desired.

In an embodiment, the pressure assembly 102 may comprise an activation mechanism 112 within the outer housing 104. In an embodiment, the activation mechanism 112 may comprise any suitable device configured to cause a pressure generating agent 127 to generate a pressure, or any means for initiating a pressure increase from a pressure generating agent 127. Suitable activation mechanisms may include, but are not limited to, percussion caps, electrically initiated sparking devices, and/or electrically initiated heat sources (e.g., filaments). Suitable electrical sources for use with an activation mechanism 112 may include, but are not limited to, batteries (e.g., high temperature batteries for use in wellbore environments) and piezo electric elements capable of generating an electrical charge sufficient to activate an activation mechanism. A power device configured to provide an impulse in the form of a physical force to a percussion cap or an electrical current to an electrically initiated activation mechanism may be disposed within the pressure assembly 102, or may not be disposed on or within the pressure assembly. Rather, the power device may be disposed on a separate device in fluid, mechanical, and/or electrical communication with the pressure assembly 102. For example, an electrical source may be disposed on an additional device mechanically coupled to the pressure assembly 102 such that when a piston or other slidingly engaged device within the additional device is sufficiently displaced, the electrical source may contact a pin connector on the pressure assembly 102 and activate the activation mechanism 112. In another embodiment, the power device may comprise a firing pin configured to provide a physical force to a percussion cap to initiate the activation mechanism.

In an embodiment shown in FIG. 1, the pressure assembly 102 comprises a pin connector 109, at least one connector wire 110, and an activation mechanism 112. The pin connector 109 may be any suitable structure for receiving an electrically conducting element and conducting an electrical charge through connector wire 110, which may be electrically insulated from the surrounding structures in the pressure assembly 102. The activation mechanism 112 may be configured to receive at least one connector wire 110 from the pin connector 109 for initiating the activation mechanism. In some embodiments, only one connector wire 110 is provided from the pin connector if the remaining structures in the pressure assembly 102 are electrically conductive. In some embodiments, a plurality of connector wires 110 may be used, for example, to avoid placing an electrical charge on the other structures in the pressure assembly 102. In an embodiment, one or more redundant connector wires 110 can be used to ensure activation of the activation mechanism 112. The activation mechanism 112 may be coupled to a pressure chamber 114 such that the activation mechanism 112 is capable of activating the pressure generating agent 127 disposed within the pressure chamber 114.

In an embodiment, a suitable activation mechanism may include any device capable of contacting a plurality of components capable of generating pressure. Suitable activation mechanisms may include, but are not limited to, rupture discs, valves, sliding barriers, diaphragms configured to be punctured, or any other separation device capable of being opened to allow fluid communication between two components. The activation mechanisms of this type can be actuated by electrical or mechanical means.

The pressure chamber 114 may be centrally disposed within the pressure assembly 102 and may be configured to contain a pressure generating agent 127. The pressure chamber 114 may be in fluid communication with the first end 106 of the pressure assembly 102 through a fluid channel 116 and a fluid passageway 118. In some embodiments not shown in FIG. 1, the pressure chamber 114 may be coupled to the first end 106 of the pressure assembly 102 through a mechanical means (e.g., a sliding piston). The pressure assembly 102 may include an optional pressure disk 120 disposed between the pin connector 109 and a body 122. In an embodiment, the pressure disk 120 may be a rupture disk, however, other types of pressure disks that provide a seal, such as a metal-to-metal seal, between pressure disk holder pin connector 109 and body 122 could also be used including a pressure membrane. The pressure disk 120 may seal the pressure chamber 114 and any pressure generating agent 127 prior to activation, which may prevent contamination of the pressure generating agent 127.

In an embodiment, the pressure chamber 114 is configured to contain a quantity of pressure generating agent 127. A pressure generating agent may comprise any suitable composition capable of generating at least about 1,000 psi, alternatively about 2,000 psi, or alternatively about 3,000 psi when activated within the wellbore. In an embodiment, the pressure generating agent may comprise a solid composition capable of reacting and/or decomposing upon activation to generate one or more gases and/or fluids within the pressure assembly 102.

In an embodiment, a solid composition suitable for use as a pressure generating agent may comprise a fuel, an oxidizer, and any number of additives suitable for use with gas generating agents. Fuels suitable for use as a solid pressure generating agent may include any compound capable of reacting to form one or more gases at an increased pressure. In an embodiment, the fuel may generally comprise an organic composition. In an embodiment, compositions suitable for use as a fuel may include, but are not limited to, materials incorporating tetrazines, tetrazine derivatives, azides (e.g., sodium azide), azide derivatives, azoles, azole derivatives (e.g., triazole derivatives, tetrazole derivatives, oxadiazole derivatives), guanidine derivatives, azodicarbon amide derivatives, hydrazine derivatives, urea derivatives, ammine complexes, nitrocellulose, any derivatives thereof, any salts thereof, and any combinations thereof. In an embodiment, the fuel may generally comprise a thermite solid composition.

Oxidizers generally assist in the reaction of the fuels to form one or more gases. Suitable oxidizers may include, but are not limited to, chlorates, perchlorates (e.g., potassium perchlorate, lithium perchlorate, and ammonium perchlorate), oxides (e.g., iron oxide), nitrites, nitrates (e.g., ammonium nitrate, potassium nitrate, and strontium nitrate), peroxides (e.g., metal peroxides), hydroxides (e.g., metal hydroxides), hydrides (e.g., sodium borohydride), dicyanamide compounds, any derivatives thereof, any salts thereof, and any combinations thereof.

Additives may include, but are not limited to, binders, coolants, slag forming agents, and processing agents. For example, coolants may include, but are not limited to, metal carbonates, metal bicarbonates, metal oxalates, and any combinations thereof. Slag forming agents may include, but are not limited to, clays, silicas, aluminas, glass, and any combinations thereof.

The solid pressure generating agents may be supplied by suppliers known in the art. Typical or known suppliers include Aldrich, Fisher Chemical companies, and Nippon Carbide. Solid pressure generating agents may be available in a variety of shapes and forms. For example, a solid pressure generating agent may be available in the shape of a pellet, a circular column, a tube, a disk, or a hollow body with both ends closed. The exact composition and form of the pressure generating agent may depend on a variety of factors including, but not limited to, temperature stability, maximum pressure generation, combustion temperature, and ignition characteristics.

In an embodiment, additional pressure generating agents suitable for use in the pressure assembly 102 may include multi-component systems comprising a plurality of reactive components that react when contacted. In this embodiment, the activation device may comprise any device capable of introducing at least one component to another. For example, the activation device may include, but is not limited to, a valving assembly for introducing one component into a chamber containing a second component. Alternatively, the activation device may comprise a percussion cap capable of breaking a seal between two components stored in the same or different chambers. In an embodiment, a multi-components system may comprise the use of a solid carbonate and/or bicarbonate (e.g., a metal bicarbonate such as sodium bicarbonate or calcium carbonate) in combination with a liquid and/or solid acid (e.g., an organic acid such as acetic acid, or a mineral acid such as hydrochloric acid). When combined, this embodiment of a multi-component system will result in the release of carbon dioxide, which may provide the increased pressure within the pressure assembly 102.

In an embodiment, the activation mechanism 112 and the pressure assembly 102 comprising a pressure generating agent 127 may be used as a source of pressure in a wellbore disposed in a subterranean formation. The pressure provided by the pressure assembly 102 may be used to operate at least one tool disposed in the wellbore that is coupled to the pressure assembly 102. In an embodiment, the activation mechanism 112 and the pressure assembly 102 may be positioned within a wellbore disposed in a subterranean formation. The pressure generating agent 127 can be disposed in the pressure chamber 114 prior to the pressure assembly 102 being placed within the wellbore. The pressure assembly 102 may be coupled to a tool at the surface of the wellbore and/or within the wellbore using any suitable techniques known in the art.

Once disposed in the wellbore, the activation mechanism 112 may be used to activate the pressure generating agent 127 to generate a pressurized fluid. The pressure generating agent may generate at least about 1,000 psi, at least about 2,000 psi, or at least about 3,000 psi of pressure within the pressure assembly 102. In an embodiment, the pressure generating agent may generate less than about 15,000 psi, less than about 13,000 psi, or less than about 10,000 psi of pressure within the pressure assembly 102. In an embodiment, a pressure regulation device can be incorporated into the pressure assembly 102 to maintain the pressure in the pressure chamber 114 below a desired value. For example, the pressure regulation device may vent any additional pressured fluid in excess of the amount needed to generate the desired pressure in the pressure reservoir to the wellbore. The pressurized fluid may then be used to operate one or more devices (e.g., downhole tools) disposed in the wellbore. For example, one or more of the devices coupled to (e.g., in fluid communication with) the pressure assembly 102 may be operated using the pressure generated by the activation of the pressure generating agent 127.

In some embodiments, the pressure generating agent 127 may be activated soon after being disposed within the wellbore. In these embodiments, the pressure assembly 102 may comprise additional devices, such as selectively operable valves to allow the pressure assembly 102 to act as a pressure reservoir for use within the wellbore. In some embodiments, the pressure generating agent 127 may not be activated until a desired time, allowing the pressure created by the activation of the pressure generating agent 127 to be used at approximately the same time it is created.

In some embodiments, the pressure created by the activation of the pressure generating agent 127 may be used for a single operation of one or more devices within the wellbore. In some embodiments, the pressure may be used to perform a plurality of operations of a device within the wellbore. In these embodiments, the pressure created by the activation of the pressure generating agent 127 may be stored in a pressure reservoir of a suitable size within the pressure assembly 102. The pressure reservoir may then be used for a plurality of operations of one or more devices. In another embodiment, a plurality of pressure assemblies 102 may be disposed within the wellbore to provide a plurality of operations of one or more devices within the wellbore. In this embodiment, a plurality of pressure chambers 114 and corresponding activation mechanisms 112 may be provided in a single pressure assembly 102, and/or a plurality of pressure assemblies 102 may be provided within the wellbore, all coupled to a device or devices to allow for the plurality of operations of the device or devices.

Figure 5:
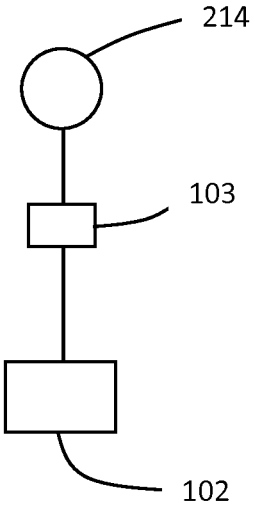
FIG. 5 is a schematic illustration of an embodiment of a sampling chamber coupled to an actuator and pressure source.

In an embodiment, the apparatus and device of the present disclosure may be used to operate one or more devices in a wellbore disposed in a subterranean formation. In an embodiment, the device may comprise a fluid sampler for obtaining fluid samples from within a wellbore and maintaining the sample in a single phase upon retrieval of the sample to the surface. An embodiment of a device coupled to a pressure assembly 102 is illustrated in FIGS. 2A-2F, where the device and pressure assembly 102 are illustrated in serial views (e.g., the lower end of FIG. 2A would be coupled to the upper end of FIG. 2B and so forth). As shown in FIGS. 2A-2F, a fluid sampling chamber 200 is shown which may be placed in a fluid sampler comprising a carrier (not shown) (e.g., housing or carrier 104 of FIG. 1) having a pressure assembly 102 coupled thereto, for use in obtaining one or more fluid samples. The sampling chamber 200 may be coupled to a carrier that may also include an actuator (not shown) (e.g., actuator 103 of FIG. 5). In an embodiment, the sampling chamber 200 and the carrier may comprise a part of a wellbore servicing system, as described in more detail below. In an embodiment, one or more sampling chambers 200 as described herein can be disposed in the carrier.

In an embodiment, a passage 210 in an upper portion of the sampling chamber 200 (see FIG. 2A) may be placed in communication with a longitudinally extending internal fluid passageway formed completely through the carrier when the fluid sampling operation is initiated using an actuator. In this way, the internal fluid passageway becomes a portion of an internal passage in a tubular string, which may be used to dispose the fluid sampler within the wellbore as discussed in more detail below. Passage 210 in the upper portion of sampling chamber 200 is in communication with a sample chamber 214 via a check valve 216. Check valve 216 permits fluid to flow from passage 210 into sample chamber 214, but prevents fluid from escaping from sample chamber 214 to passage 210.

In some embodiments, a debris trap may be used with the fluid sampler. In these embodiments, a debris trap piston 218 is disposed within housing 202 and separates sample chamber 214 from a meter fluid chamber 220. When a fluid sample is received in sample chamber 214, debris trap piston 218 is displaced downwardly relative to housing 202 to expand sample chamber 214. Prior to such downward displacement of debris trap piston 218, however, fluid flows through sample chamber 214 and passageway 222 of piston 218 into debris chamber 226 of debris trap piston 218. The fluid received in debris chamber 226 is prevented from escaping back into sample chamber 214 due to the relative cross sectional areas of passageway 222 and debris chamber 226 as well as the pressure maintained on debris chamber 226 from sample chamber 214 via passageway 222. An optional check valve (not pictured) may be disposed within passageway 222 if desired. Such a check valve would operate to allow fluid to flow from the sample chamber 214 into the debris chamber 226 and prevent flow from debris chamber 226 into the sample chamber 214. In this manner, the fluid initially received into sample chamber 214 is trapped in debris chamber 226. Debris chamber 226 thus permits this initially received fluid to be isolated from the fluid sample later received in sample chamber 214. Debris trap piston 218 can include a magnetic locator 224 used as a reference to determine the level of displacement of debris trap piston 218 and thus the volume within sample chamber 214 after a sample has been obtained.

In an embodiment, meter fluid chamber 220 initially contains a metering fluid, such as a hydraulic fluid, silicone oil or the like. A flow restrictor 234 and a check valve 236 control flow between chamber 220 and an atmospheric chamber 238 that initially contains a gas at a relatively low pressure such as air at atmospheric pressure. A collapsible piston assembly 240 includes a prong 242 which initially maintains check valve 244 off seat, so that flow in both directions is permitted through check valve 244 between chambers 220, 238. When elevated pressure is applied to chamber 238, however, as described more fully below, piston assembly 240 collapses axially, and prong 242 will no longer maintain check valve 244 off seat, thereby preventing flow from chamber 220 to chamber 238.

A piston 246 disposed within housing 202 separates chamber 238 from a longitudinally extending atmospheric chamber 248 that initially contains a gas at a relatively low pressure such as air at atmospheric pressure. Piston 246 can include a magnetic locator 247 used as a reference to determine the level of displacement of piston 246 and thus the volume within chamber 238 after a sample has been obtained. Piston 246 comprises a trigger assembly 250 at its lower end. In the illustrated embodiment, trigger assembly 250 is threadably coupled to piston 246 which creates a compression connection between a trigger assembly body 252 and a pin connection 254. Alternatively, pin connection 254 may be coupled to trigger assembly body 252 via threading, welding, friction or other suitable technique. Pin connection 254 comprises a hollow interior where one or more suitable sources of an electrical charge 251 (e.g., high temperature lithium batteries) are configured to provide an electrical current through the tip of pin connection 254. The tip of pin connection 254 may be threaded or otherwise removably engaged to the body of the pin connection 254 to allow for replacement of the one or more batteries as needed. As discussed more fully below, pin connection 254 is used to actuate the activation mechanism 112 of the pressure assembly 102 when piston 246 is sufficiently displaced relative to housing 202.

Below atmospheric chamber 248 and disposed within the longitudinal passageway of housing 202 is the pressure assembly 102, as described above. The pressure assembly 102 may have a pin connector 109 configured to mate with the pin connection 254 on the piston 246. In an embodiment, pin connector 109 is electrically coupled to an activation mechanism 112 through one or more connector wires 110. The activation mechanism 112 is disposed in communication with a pressure chamber 114 configured to contain a pressure generating agent 127, and is capable of activating the pressure generating agent 127 to produce an increased pressure in the pressure chamber 114. Pressure chamber 114 is in fluid communication with fluid channel 116, which is in fluid communication with atmospheric chamber 248 through the fluid channel 116 and fluid passageway 118. A rupture disk, for example the pressure disk 120, may be disposed in fluid channel 116 to prevent the flow of any fluids from atmospheric chamber 248 into the pressure chamber 114 until after the activation of the pressure generating agent 127 by the activation mechanism 112. Upon activation of the pressure generating agent 127, the rupture disk may be breached to allow flow of a pressurized fluid from the pressure chamber 114 to chamber 248.

Figure 3:
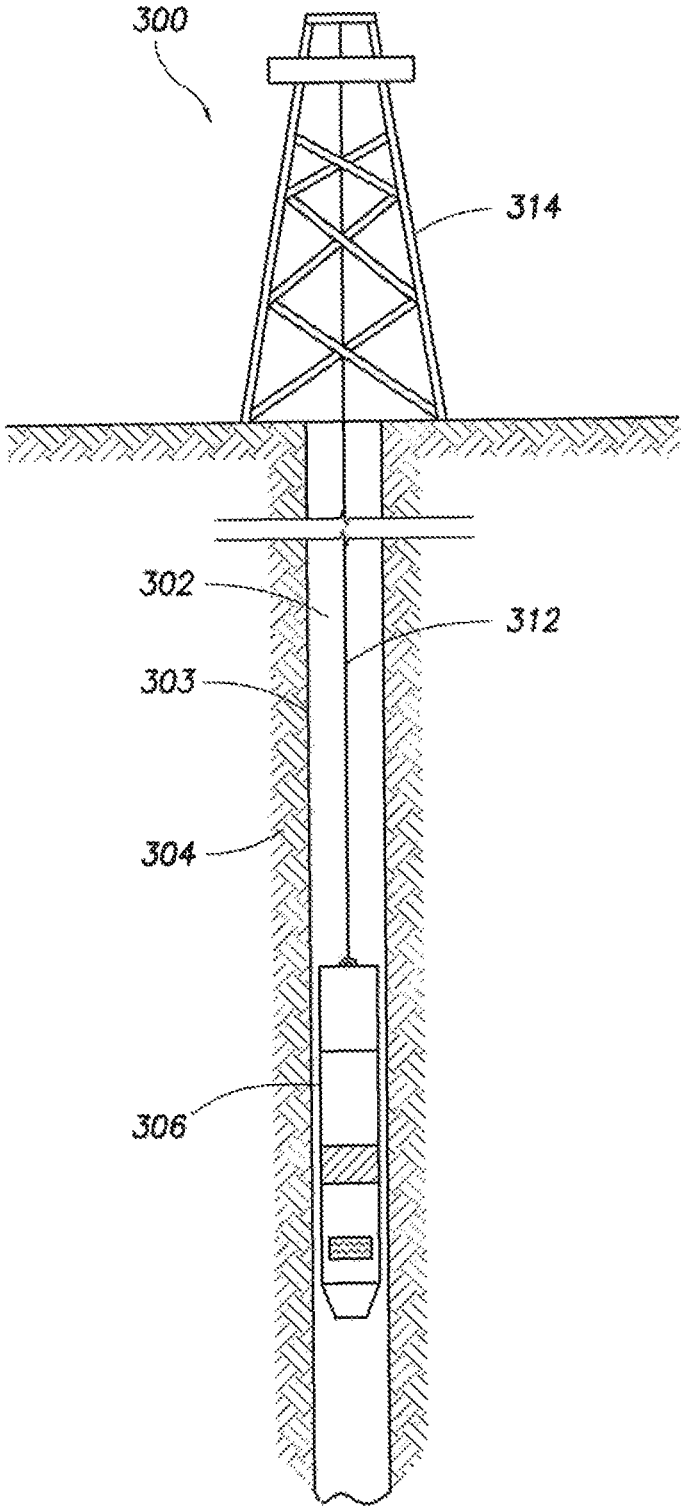
FIG. 3 is an illustration of a wellbore servicing system according to an embodiment of the present disclosure.
Figure 4:
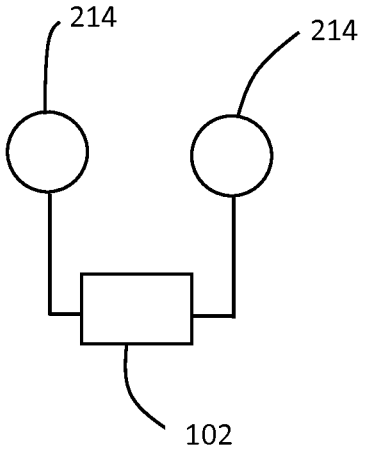
FIG. 4 is a schematic illustration of an embodiment of a plurality of sampling chambers coupled to a pressure source.

In an embodiment, a fluid sampler comprising a fluid sampling chamber 200 and associated pressure assembly 102 may comprise a portion of a wellbore servicing system as shown in FIG. 3. In an embodiment, the system 300 comprises a servicing rig 314 that extends over and around a wellbore 302 that penetrates a subterranean formation 304 for the purpose of recovering hydrocarbons, storing hydrocarbons, disposing of carbon dioxide, or the like. The wellbore 302 may be drilled into the subterranean formation 304 using any suitable drilling technique. While shown as extending vertically from the surface in FIG. 3, in some embodiments the wellbore 302 may be deviated, horizontal, and/or curved over at least some portions of the wellbore 302. Reference to up or down will be made for purposes of description with "up," "upper," "upward," or "upstream" meaning toward the surface of the wellbore and with "down," "lower," "downward," or "downstream" meaning toward the terminal end of the wellbore, regardless of the wellbore orientation.

The servicing rig 314 may be one of a drilling rig, a completion rig, a workover rig, a servicing rig, or other mast structure and supports a toolstring 306 and a conveyance 312 in the wellbore 302, but in other embodiments a different structure may support the toolstring 306 and the conveyance 312, for example an injector head of a coiled tubing rigup. In an embodiment, the servicing rig 314 may comprise a derrick with a rig floor through which the toolstring 306 and conveyance 312 extends downward from the servicing rig 314 into the wellbore 302. In some embodiments, such as in an off-shore location, the servicing rig 314 may be supported by piers extending downwards to a seabed. Alternatively, in some embodiments, the servicing rig 314 may be supported by columns sitting on hulls and/or pontoons that are ballasted below the water surface, which may be referred to as a semi-submersible platform or rig. In an off-shore location, a casing may extend from the servicing rig 314 to exclude sea water and contain drilling fluid returns. It is understood that other mechanical mechanisms, not shown, may control the run-in and withdrawal of the toolstring 306 and the conveyance 312 in the wellbore 302, for example a draw works coupled to a hoisting apparatus, a slickline unit or a wireline unit including a winching apparatus, another servicing vehicle, a coiled tubing unit, and/or other apparatus.

The toolstring 306 may be comprised of one or more fluid samplers, which comprise a fluid sample chamber 200 and a pressure assembly 102. The toolstring 306 may also comprise one or more additional downhole tools, for example a packer, retrievable bridge plug, and/or a setting tool. The conveyance 312 may be any of a string of jointed pipes, a slickline, a coiled tubing, a wireline, and other conveyances for the toolstring 306. In another embodiment, the toolstring 306 may comprise additional downhole tools located above or below the fluid sampler.

The toolstring 306 may be coupled to the conveyance 312 at the surface and run into the wellbore casing 303, for example a wireline unit coupled to the servicing rig 314 may run the toolstring 306 that is coupled to a wireline into the wellbore casing 303. In an embodiment, the conveyance may be a wireline, an electrical line, a coiled tubing, a drill string, a tubing string, or other conveyance. At target depth, the actuator in the fluid sampler may be actuated to initiate the sampling of the formation fluid in response to a signal sent from the surface and/or in response to the expiration of a timer incorporated into the fluid sampler or fluid sampler carrier.

As described above with reference to FIGS. 2A-2F, once the fluid sampler is in its operable configuration and is located at the desired position within the wellbore 302, a fluid sample can be obtained in one or more sample chambers 214 by operating an actuator in the carrier to allow the formation fluids surrounding the carrier to flow into the sampling chamber. Fluid from the subterranean formation 304 can then enter passage 210 in the upper portion of the sampling chamber 200. The fluid flows from passage 210 through check valve 216 to sample chamber 214. It is noted that check valve 216 may include a restrictor pin 268 to prevent excessive travel of ball member 270 and over compression or recoil of spiral wound compression spring 272. An initial volume of the fluid is trapped in debris chamber 226 of piston 218 as described above. Downward displacement of piston 218 is slowed by the metering fluid in chamber 220 flowing through restrictor 234. Proper sizing of the restrictor can prevent the pressure of the fluid sample received in sample chamber 214 from dropping below its bubble point.

As piston 218 displaces downward, the metering fluid in chamber 220 flows through restrictor 234 into chamber 238. At this point, prong 242 maintains check valve 244 off seat. The metering fluid received in chamber 238 causes piston 246 to displace downwardly. Eventually, pin connector 254 contacts pin connector 109 on the pressure assembly 102. The resulting electrical charge causes activation mechanism 112 to activate the pressure generating agent 127 in pressure chamber 114. The resulting pressure increase in pressure chamber 114 breaches rupture disk, for example the pressure disk 120, permitting pressure from pressure assembly 102 to be applied to chamber 248. Specifically, once the pressure generating agent 127 is activated, the pressure from pressure assembly 102 passes through fluid channel 116 and fluid passageway 118 to chamber 248. Pressurization of chamber 248 also results in pressure being applied to chambers 238, 220 and thus to sample chamber 214.

When the pressure from pressure assembly 102 is applied to chamber 238, pins 278 are sheared allowing piston assembly 240 to collapse such that prong 242 no longer maintains check valve 244 off seat. Check valve 244 then prevents pressure from escaping from chamber 220 and sample chamber 214. Check valve 216 also prevents escape of pressure from sample chamber 214. In this manner, the fluid sample received in sample chamber 214 remains pressurized, which may prevent any phase separation of the fluid sample.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of pressurizing a fluid sample, the method comprising:

disposing a fluid sampler comprising a sampling chamber, a power device, and a pressure assembly comprising an activation mechanism in a subterranean wellbore, wherein the pressure assembly comprises a pressure generating agent, wherein the power device is positioned between the sampling chamber and the pressure assembly, and wherein the pressure assembly is at or near atmospheric pressure while disposing the fluid sampler in the subterranean wellbore;

obtaining a fluid sample in the sampling chamber while maintaining the pressure assembly at or near atmospheric pressure;

activating, within the subterranean wellbore, the pressure generating agent with the activation mechanism in response to obtaining the fluid sample in the sampling chamber;

generating a pressurized fluid having a pressure greater than atmospheric pressure within the pressure assembly in response to activating the pressure generating agent; and pressurizing the fluid sample using the pressurized fluid.

2. The method of claim 1, wherein the activating of the pressure generating agent occurs after the obtaining of the fluid sample.

3. The method of claim 1, wherein the pressure generating agent comprises a solid composition.

4. The method of claim 3, wherein the solid composition comprises an organic solid composition comprising a urea, a multi-component system, or any combination thereof.

5. The method of claim 3, wherein the solid composition comprises a fuel and an oxidizer.

6. The method of claim 5, wherein the fuel comprises at least one composition selected from the group consisting of: a tetrazine, an azide, an azole, a triazole, a tetrazole, an oxadiazole, a guanidine, an azodicarbon amide, a hydrazine, an ammine complex, a nitrocellulose, any derivative thereof, any salt thereof, and any combination thereof.

7. The method of claim 5, wherein the oxidizer comprises at least one composition selected from the group consisting of: a chlorate, a perchlorate, an oxide, a nitrite, a nitrate, a peroxide, a hydroxide, a hydride, a dicyanamide compound, any derivative thereof, any salt thereof, and any combination thereof.

8. The method of claim 3, wherein the solid composition further comprises at least one additive selected from the group consisting of: a binder, a coolant, a slag forming agent, and a processing agent.

9. The method of claim 1, wherein the activation mechanism comprises a percussion cap, or an electrically initiated activation mechanism.

10. The method of claim 1, wherein the activation mechanism comprises an electrically initiated sparking device or an electrically initiated heat source.

11. The method of claim 1, wherein the power device is configured to provide an impulse for activating the activation mechanism, wherein the power device is separate from the pressure assembly and the activation mechanism.

12. The method of claim 1, wherein the pressure generating agent comprises a first component and a second component, wherein the first component is selected from the group consisting of: a carbonate and a bicarbonate, and wherein the second component comprises an acid.

13. The method of claim 1, wherein the pressurized fluid has a pressure of at least about 1,000 pounds per square inch.

14. A method of generating pressure for use in pressurizing a fluid sample within a subterranean wellbore, the method comprising:

positioning a sampling chamber, a power device, and a pressure assembly comprising an activation mechanism and a pressure generating agent within a subterranean wellbore, wherein the pressure assembly is at a first pressure when the pressure assembly is positioned in the subterranean wellbore, and wherein the power device is positioned between the sampling chamber and the pressure assembly;

obtaining a fluid sample in the sampling chamber;

activating, within the subterranean wellbore, the pressure generating agent with the activation mechanism to generate a pressurized fluid in response to obtaining the fluid sample in the sample chamber, wherein the pressurized fluid is at a second pressure, and wherein the second pressure is greater than the first pressure; and using the pressurized fluid to pressurize the fluid sample in the sampling chamber in response to the activating.

15. The method of claim 14, wherein the pressure generating agent comprises a solid composition.

16. The method of claim 15, wherein the solid composition comprises at least one composition selected from the group consisting of: a tetrazine, azide, an azole, a triazole, a tetrazole, an oxadiazole, a guanidine, an azodicarbon amide, a hydrazine, an ammine complex, a nitrocellulose, any derivative thereof, any salt thereof, and any combination thereof.

17. The method of claim 14, wherein the power device is operably associated with the fluid sampler, wherein the power device is separate from the pressure assembly and the activation mechanism.

18. The method of claim 17, further comprising translating the power device into engagement with the activation mechanism, and providing an impulse for activating the activation mechanism based on the engagement of the power device with the activation mechanism.

19. The method of claim 18, wherein the impulse is a mechanical impulse or an electrical impulse.

20. The method of claim 18, wherein activating the pressure generating agent to generate the pressurized fluid occurs in response to the impulse.

* * * * *